US006367454B1

(12) United States Patent
Rembold et al.

(10) Patent No.: US 6,367,454 B1
(45) Date of Patent: Apr. 9, 2002

(54) METHOD FOR OPERATING AN INTERNAL COMBUSTION ENGINE MAINLY IN A MOTOR VEHICLE

(75) Inventors: Helmut Rembold, Stuttgart; Hansjoerg Bochum, Leinfelden, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,468

(22) PCT Filed: Nov. 9, 1999

(86) PCT No.: PCT/DE99/03564

§ 371 Date: Aug. 24, 2000

§ 102(e) Date: Aug. 24, 2000

(87) PCT Pub. No.: WO00/31398

PCT Pub. Date: Jun. 2, 2000

(30) Foreign Application Priority Data

Nov. 21, 1998 (DE) ..... 198 53 823

(51) Int. Cl.[7] ..... F02M 37/04
(52) U.S. Cl. ..... 123/497; 123/179.17
(58) Field of Search ..... 123/497, 179.17, 123/456, 446, 357, 514

(56) References Cited

U.S. PATENT DOCUMENTS 4,982,331 A * 1/1991 Miyazaki ..... 701/102
5,085,193 A * 2/1992 Morikawa ..... 123/458
5,237,975 A * 8/1993 Betki et al. ..... 123/497
5,293,299 A * 3/1994 Iwabuchi et al. ..... 361/152
5,379,741 A 1/1995 Matysiewics et al.
5,483,940 A * 1/1996 Namba et al. ..... 123/497
5,617,831 A * 4/1997 Shirakawa ..... 123/502

FOREIGN PATENT DOCUMENTS

DE 41 40 329 A1 6/1993
DE 44 46 277 6/1996
DE 195 39 883 A 11/1996
DE 196 25 902 A 3/1997

OTHER PUBLICATIONS

Patent Abstract of Japan, vol. 1997, No. 01, Jan. 31, 1997 & JP 08 232703 A, Sep. 10, 1996.
Derwent Information Ltd, JP 08–296476 A.

* cited by examiner

*Primary Examiner*—Carl S. Miller
(74) *Attorney, Agent, or Firm*—Michael J. Striker

(57) ABSTRACT

An internal combustion engine, in particular for a motor vehicle, which is provided with a fuel pump which can deliver fuel into a pressure reservoir. A control device is provided, which is connected to the fuel pump. The delivery quantity of the fuel pump can be changed and the fuel quantity supplied to the pressure reservoir can be adjusted to a required fuel quantity by influencing the delivery quantity of the fuel pump. The control device can control the delivery quantity of the fuel pump by a program map as a function of a number of input variables during the startup of the engine.

2 Claims, 2 Drawing Sheets

METHOD FOR OPERATING AN INTERNAL COMBUSTION ENGINE MAINLY IN A MOTOR VEHICLE

BACKGROUND OF THE INVENTION

DESCRIPTION OF THE PRIOR ART

The invention relates to a method for operating an internal combustion engine, in particular of a motor vehicle, in which fuel is delivered by a fuel pump into a pressure reservoir, in which the delivery quantity of the fuel pump can be changed, and in which the fuel quantity supplied to the pressure reservoir is adjusted to a required fuel quantity by influencing the delivery quantity of the fuel pump. The invention also relates to an internal combustion engine, in particular for a motor vehicle, having a fuel pump with which fuel can be delivered into a pressure reservoir and having a control device that is connected to the fuel pump, wherein the delivery quantity of the fuel pump can be changed and wherein the fuel quantity supplied to the pressure reservoir can be adjusted to a required fuel quantity by influencing the delivery quantity of the fuel pump.

This kind of method and internal combustion engine are generally known. The fuel is fed into a pressure reservoir of the internal combustion engine by a first fuel pump, which is usually driven in an electromotive fashion, and by a second high-pressure pump, which is usually mechanical. The fuel quantity delivered can be changed, for example, by means of a corresponding influence on the electromotively driven first fuel pump. In this manner, the respectively required fuel quantity is supplied to the pressure reservoir. The injection valves are connected to the pressure reservoir, with the aid of which the fuel is injected into the individual cylinders of the internal combustion engine. The required fuel quantity supplied to the pressure reservoir thereby corresponds largely to the fuel quantity injected into the cylinders of the engine by the injection valves.

SUMMARY OF THE INVENTION

The object of the invention is to develop a method for operating an internal combustion engine as well as to produce an internal combustion engine in which the required fuel quantity is supplied to the pressure reservoir in the simplest possible manner.

This object is attained according to the invention with a method of the type mentioned at the beginning by virtue of the fact that the fuel quantity of the fuel pump is controlled via a program map as a function of a number of input variables. The object is also attained according to the invention with an internal combustion engine of the type mentioned at the beginning by virtue of the fact that the control device can control the delivery quantity of the fuel pump via a program map as a function of a number of input variables.

The delivery quantity of the fuel pump and thereby the fuel quantity supplied to the pressure reservoir is consequently controlled via the program map. This kind of map-dependent control represents a simple, but extremely effective manner of influencing the delivery quantity of the fuel pump and thereby the adjustment to the required fuel quantity. As a result, no significant expense is required in order to control the delivery quantity of the fuel pump.

It is particularly advantageous if the delivery quantity of the fuel pump is controlled via the program map as a function of the fuel quantity to be injected and/or the speed of the engine and/or the temperature of the intake air and/or the battery voltage. With the aid of these input variables, it is possible by simple means to generate a program map and to control the delivery quantity of the fuel pump via this program map.

In a preferred embodiment of the invention, the program map is equalized during a startup of the engine, particularly at the beginning of the startup.

In this manner, it is possible to equalize tolerances of different fuel pumps as well as age-related changes. The tolerances and changes are therefore taken into account and can be compensated for. The tolerances and also the changes consequently have no negative influence on the map-dependent control of the delivery quantity of the fuel pump.

It is particularly advantageous if the program map is equalized with each startup of the engine. In this instance, even extremely small changes in the fuel pump can be detected with each startup of the engine and can therefore be immediately taken into account. This produces a particularly precise and reliable control of the delivery quantity of the fuel pump.

In a preferred modification of the invention, the program map is equalized when the ignition contact of the engine is switched on, and/or the program map is equalized when the speed of the engine is lower than a predetermined threshold value. With these alternative or mutually supplementary measures, it is possible to detect a startup of the engine in a simple manner. Thus, it is possible on the one hand for the program map to be equalized when the ignition of the engine is switched on by the driver. It is likewise possible for the program map to be equalized when the speed of the engine is below the predetermined threshold value. These two measures can be used individually or in combination.

In a preferred embodiment of the invention, the actual value of the pressure in the pressure reservoir is measured, a reference value of the pressure in the pressure reservoir is determined as a function of the required fuel quantity, and the actual value and reference value are compared to each other and the program map is equalized a function of this comparison.

The equalization of the program map consequently occurs in a pressure-dependent fashion. The reference value and the actual value of the pressure in the pressure reservoir are compared to each other for this purpose. If there is a difference between them, then this means that the reference value generated by means of the map-dependent control does not result in an identical actual value. As a result, the program map is influenced and changed in such a way or until the actual value corresponds to the predetermined reference value. If so desired or if necessary, this equalization of the program map can be carried out not only at the beginning but also possibly during the actual startup of the engine.

In an advantageous improvement of the invention, the pressure in the pressure reservoir can be changed by means of a valve associated with the pressure reservoir and the valve is open during the equalization of the program map. This changes a pressure increase in the pressure reservoir during the equalization of the program map. It is consequently assured that during the equalization, only the map-dependent control acting via the fuel pump determines the pressure in the pressure reservoir. This simple measure achieves the fact that the comparison of the actual value to the reference value of the pressure in pressure reservoir is sufficient for the equalization of the program map.

Other features, potential applications, and advantages of the invention ensue from the subsequent description of exemplary embodiments of the invention which are shown in the drawings. All of the features described or depicted, whether by themselves or in arbitrary combinations, constitute the subject of the invention, independent of their combination in the claims or their dependencies and independent of their formulation or depiction in the description or in the drawings.

DETAILED DESCRIPTION OF THE INVENTION

Figure 1:
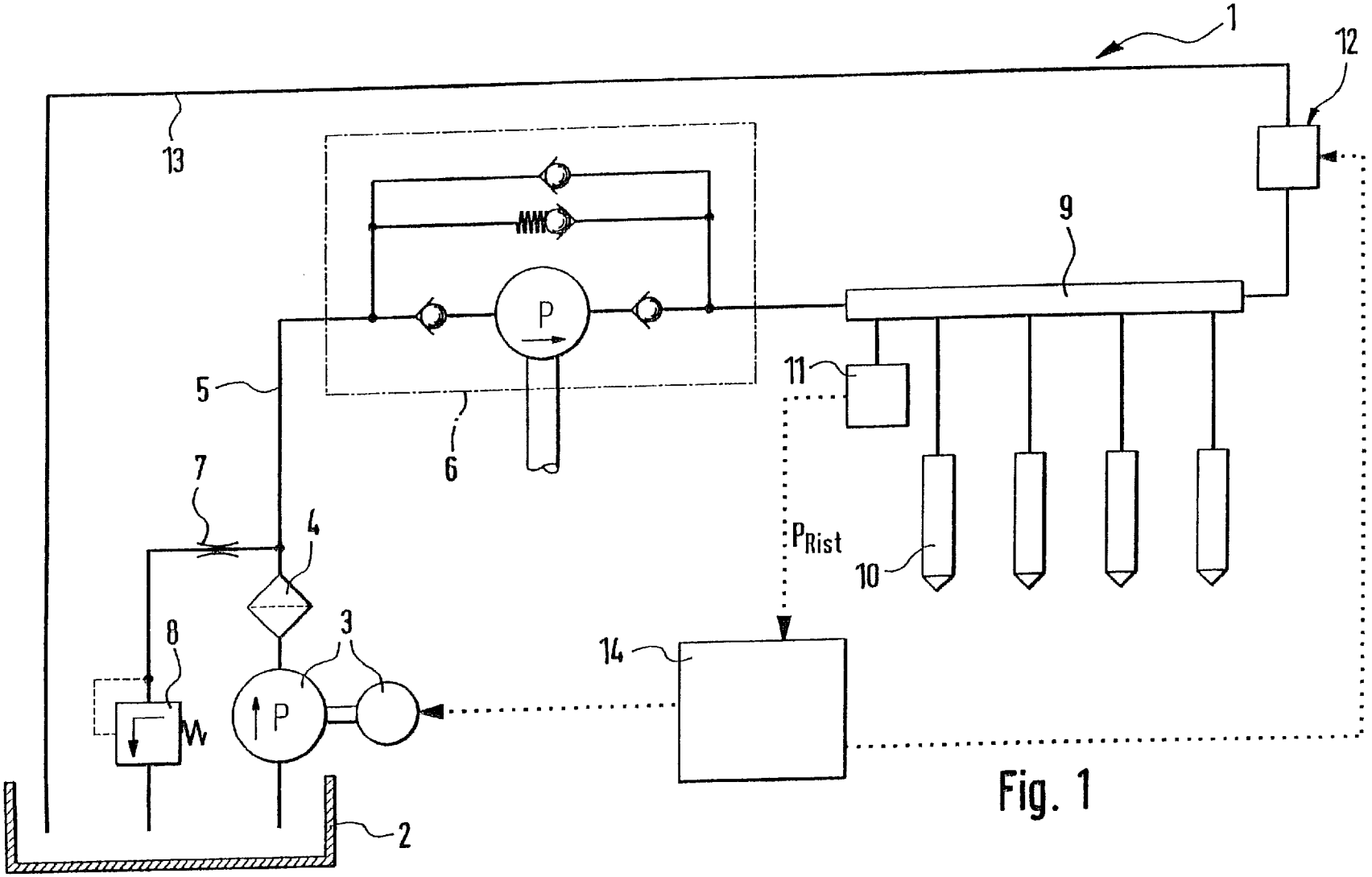
FIG. 1 shows a schematic block circuit diagram of an exemplary embodiment of a fuel supply system of an internal combustion engine.

FIG. 1 shows a fuel supply system 1, which is provided for use in an internal combustion engine, in particular of a motor vehicle. Preferably, this engine is a direct-injection internal combustion engine in which during idling and at low loads, the fuel is injected into the cylinders of the engine with stratified-charge operation and at high loads, the fuel is injected into the cylinders in a homogeneous operation. In stratified-charge operation, the fuel is injected into the immediate vicinity of the spark plug, in fact during the compression phase. By contrast, in homogeneous operation, the fuel is injected only during the intake phase so that it is swirled until being ignited by the spark plug. In particular, the stratified-charge operation is suited to reducing the fuel consumption and pollutant emissions of the engine.

The fuel supply system 1 in FIG. 1 has a fuel tank 2 from which fuel is aspirated by means of a first fuel pump 3. The first fuel pump 3 is an electromotively driven fuel pump whose speed and thereby delivery quantity can be influenced by means of a corresponding input signal.

The first fuel pump 3 is followed by a filter 4 from which the fuel delivered travels to a second fuel pump 6 via a fuel line 5. The second fuel pump 6 is a mechanical high-pressure pump.

A throttle 7 branches from the fuel line 5 and is then routed back into the fuel tank 2 via a pressure-control valve 8.

The fuel delivered travels from the second fuel pump 6 into a pressure reservoir 9. Injection valves 10 are connected to the pressure reservoir 9 and their number corresponds to the number of cylinders of the internal combustion engine. A pressure sensor 11 is also connected to the pressure reservoir 9 and its output signal $p_{Rist}$ corresponds to the actual value of the pressure in the pressure reservoir 9.

The pressure reservoir 9 also has a pressure-control valve 12 connected to it, from which the fuel is returned to the fuel tank 2 via a fuel line 13. The pressure-control valve 12 can be opened and closed by means of an input signal.

An electronic control device 14 is provided, which is supplied with the output signal of the pressure sensor 11 and which generates the input signals for the first fuel pump 3 and for the pressure-control valve 12.

Figure 2:
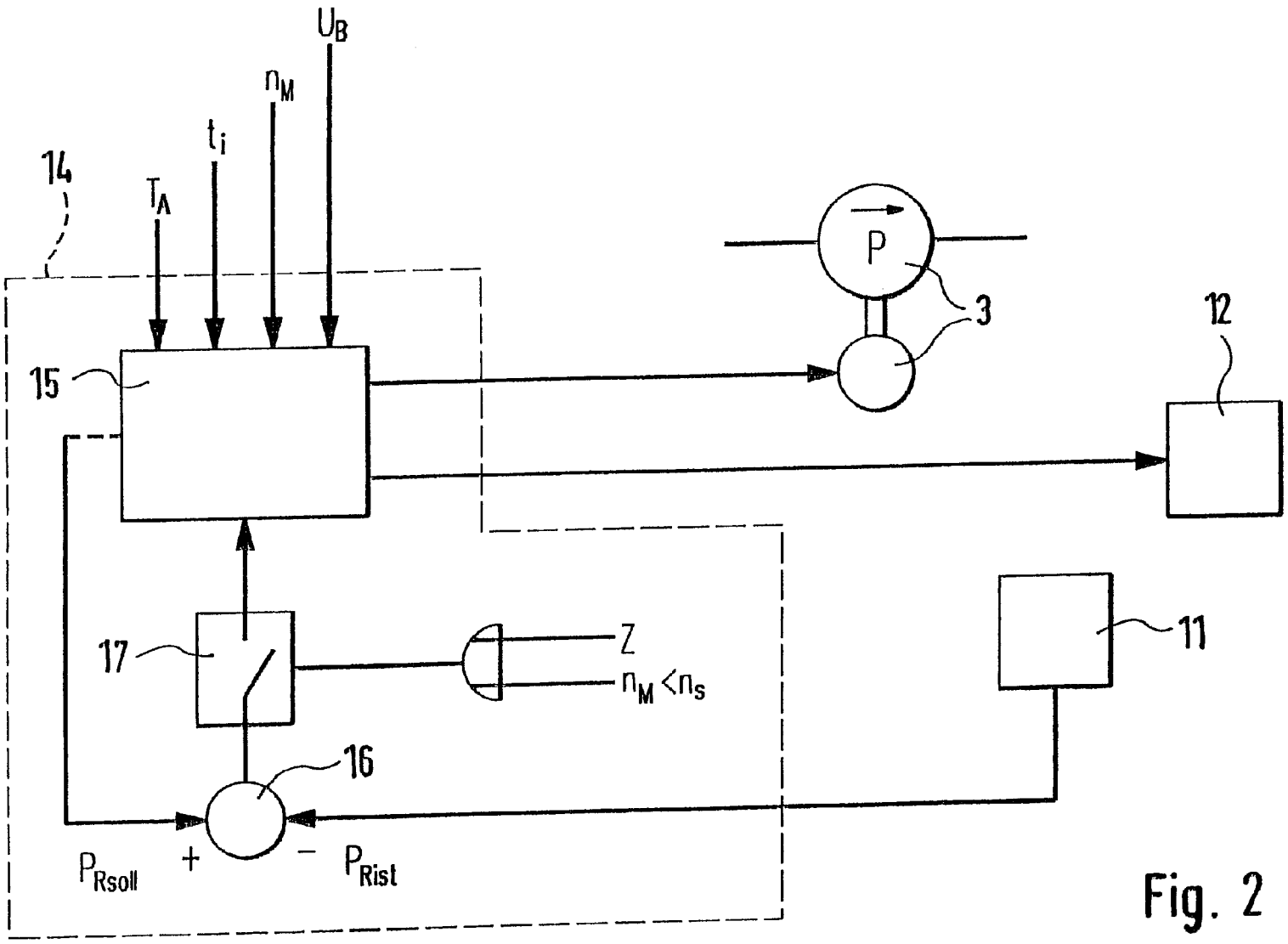
FIG. 2 shows a schematic block circuit diagram of a control mechanism of the fuel supply system from FIG. 1.

In FIG. 2, the output signal of the pressure sensor 11 is supplied to the electronic control device 14 as explained above. The electronic control device 14 generates the above-explained input signals for the first fuel pump 3 and the pressure-control valve 12.

The electronic control device 14 is provided to determine the fuel quantity to be injected into the individual cylinders. Likewise, the electronic control device determines the required fuel quantity which must be delivered into the pressure reservoir in order to compensate for the fuel quantity injected via the injection valves 10. The required fuel quantity is then adjusted by the electronic control device 14 by means of a corresponding influence on the first fuel pump 3. The electronic control device 14 consequently influences the delivery quantity of the first fuel pump 3 in such a way that the required fuel quantity is supplied to pressure reservoir 9 of the fuel supply system 1.

The influence on the delivery quantity of the first fuel pump 3 by means of the electronic control device 14 is exercised as a function of a number of input variables. The input variables can be the fuel quantity to be injected, which is equivalent to the injection time $t_i$, and/or the speed of the engine $n_M$ and/or the temperature of the intake air $T_a$, which is equivalent to the ambient temperature of the engine, and/or the battery voltage $U_B$. An additional input variable that can also be used is the actual value $p_{Rist}$ of the pressure in the pressure reservoir 9.

In the electronic control device 14, there is a program map 15 that generates an output signal from the plurality of input variables, which is supplied as an input signal to the first fuel pump 3. The map-dependent input signal of the first fuel pump 3 is constituted in such a way that the first fuel pump 3 supplies precisely the amount of fuel to the pressure reservoir 9 that is required for injection of the fuel via the injection valves 10. If necessary, a slight excess quantity can be provided which can be returned to the fuel tank 2 via the fuel line 13.

The delivery quantity of the first fuel pump 3 is thus controlled with the aid of the program map 15. This results in a map-dependent demand control of the required fuel quantity.

In over to compensate for tolerances or wear-related changes particularly in the first fuel pump 3, the program map 15 can undergo an equalization. The equalization of the program map 15 takes place during a startup of the engine. It is possible that the equalization is carried out with each startup of the engine. In this connection, the equalization preferably occurs at the beginning of the startup.

In order to carry out the equalization, the electronic control device 14 determines a reference value $p_{RSoll}$ for the pressure in the pressure reservoir 9 as a function of a plurality of input variables. The input variables can be the same input variables that are supplied to the program map 15. If need be, the reference value $p_{Rsoll}$ can also be derived from the program map 15.

The reference value $p_{RSoll}$ and the actual value $p_{Rist}$ are compared to each other by means of a subtraction 16. The comparison result is supplied to the program map 15. Depending on this comparison result, the program map 15 is influenced and changed in such a way that the comparison result becomes smaller and approaches zero.

Therefore, if the driver of the motor vehicle switches on the ignition Z of the internal combustion engine, then this activates the above-described equalization of the program map 15. This is symbolically depicted in FIG. 2 by means of a switch 17. As long as the speed $n_M$ of the internal combustion engine is lower than a threshold value $n_s$ of this speed, the switch 17 remains closed and therefore the equalization remains activated. During this time, the electronic control device 14 can change the program map 15 in such a way that the reference value $p_{Rsoll}$ and the actual value $p_{Rist}$ of the pressure in the pressure reservoir 9 become equal. If this is the case, then a further influence on the program map 15 is no longer necessary.

This influencing and changing of the program map is intrinsically intended to be carried out before the beginning of the actual startup of the engine, i.e. before the first injection of fuel into the cylinders of the engine. However, it is also possible for the equalization of the program map 15 to be carried out only during the actual startup of the engine, i.e. when fuel is already being injected into the cylinders. In this instance, the fuel quantity injected by means of the injection valves 10 must be taken into account in the equalization of the program map 15.

The throttle 7 shown in FIG. 1 is provided to increase the pressure produced by the first fuel pump 3 in the fuel line 5 immediately after the starting of the internal combustion engine. During this starting phase, the first fuel pump 3 is operated at its maximal available output and therefore with the maximal fuel quantity that can be supplied. During the equalization of the program map 15, the pressure-control valve 12 is open. Consequently, a pressure increase by means of the second fuel pump 6 is prevented. After the threshold value $n_s$ for the speed of the engine is exceeded, the pressure-control valve 12 is closed. Then a pressure increase is produced in the pressure reservoir 9 by means of the second fuel pump 6. After the threshold value $n_s$ has been exceeded, the first fuel pump 3 is operated by means of the map-dependent demand control described above.

What is claimed is:

1. A method for operating an internal combustion engine of a motor vehicle, comprising a fuel pump (3), a pressure reservoir (9) and a control device (14) including a program map (15) for generating a map-dependent signal for the fuel pump, wherein fuel is supplied by the fuel pump into the pressure reservoir (9), and wherein the delivery quantity of the fuel pump (3) can be changed, and the fuel quantity delivered to the pressure reservoir (9) is adjusted to a required fuel quantity by influencing the delivery quantity of the fuel pump (3), the delivery quantity of the fuel pump (3) being controlled via the program map (15) as a function of a number of input variables received by the program map to generate the map-dependent signal as an input signal of the fuel pump, wherein the program map is equalized during a startup of the engine when the speed ($n^M$) of the engine is lower than a predetermined threshold value ($n_s$).

2. A method for operating an internal combustion engine of a motor vehicle, comprising a fuel pump (3), a pressure reservoir (9) and a control device (14) including a program map (15) for generating a map-dependent signal for a fuel pump, wherein fuel is supplied by the fuel pump into the pressure reservoir (9), and wherein the delivery quantity of the fuel pump (3) can be changed, and the fuel quantity delivered to the pressure reservoir (9) is adjusted to a required fuel quantity by influencing the delivery quantity of the fuel pump (3), the delivery quantity of the fuel pump (3) being controlled via the program map (15) as a function of a number of input variables received by the program map to generate the map-dependent signal as an input signal of the fuel pump, wherein the program map is equalized during the startup of the engine, pressure in the pressure reservoir (9) can be changed by means of a valve (12) connected to the pressure reservoir (9), and the valve (12) is open during the equalization of the program map (15).

* * * * *